US007603825B2

(12) United States Patent
Döhren

(10) Patent No.: US 7,603,825 B2
(45) Date of Patent: Oct. 20, 2009

(54) ELONGATE RETAINING ELEMENT

(75) Inventor: Hans-Jürgen Döhren, Guldental (DE)

(73) Assignee: Corus Bausysteme GmbH, Koblenz (DE)

( * ) Notice: Subject to any disclaimer, the term of this patent is extended or adjusted under 35 U.S.C. 154(b) by 653 days.

(21) Appl. No.: 10/525,556

(22) PCT Filed: Aug. 29, 2003

(86) PCT No.: PCT/EP03/09731

§ 371 (c)(1),
(2), (4) Date: Oct. 4, 2005

(87) PCT Pub. No.: WO2004/022877

PCT Pub. Date: Mar. 18, 2004

(65) Prior Publication Data

US 2006/0101763 A1 May 18, 2006

(30) Foreign Application Priority Data

Sep. 3, 2002 (EP) ..... 02078740

(51) Int. Cl.
*E04D 1/34* (2006.01)
*E04D 1/36* (2006.01)
*E04C 3/28* (2006.01)

(52) U.S. Cl. ..... 52/478; 52/520; 52/309.16; 52/834; 52/847; 52/842

(58) Field of Classification Search ..... 52/309.7, 52/309.13, 309.15, 309.16, 834, 835, 831, 52/836, 846, 847, FOR. 126, FOR. 133, FOR. 139, 52/483.1, 520, 536, 537, 545, 506.05, 543, 52/551, 478, 841, 842
See application file for complete search history.

(56) References Cited

U.S. PATENT DOCUMENTS

| | | | | |
|---|---|---|---|---|
| 2,252,956 | A * | 8/1941 | Adler | 52/376 |
| 3,462,906 | A * | 8/1969 | Schroyer | 52/478 |
| 3,555,758 | A * | 1/1971 | Schroter | 52/309.9 |
| 3,922,828 | A | 12/1975 | Patton | |
| 4,075,806 | A * | 2/1978 | Alderman | 52/90.1 |
| 4,642,961 | A * | 2/1987 | Cruise | 52/408 |
| 4,649,684 | A * | 3/1987 | Petree et al. | 52/395 |

(Continued)

FOREIGN PATENT DOCUMENTS

| | | |
|---|---|---|
| DE | 4007926 | 8/1991 |

(Continued)

*Primary Examiner*—Robert J Canfield
*Assistant Examiner*—Jessie Fonseca
(74) *Attorney, Agent, or Firm*—Novak Druce + Quigg LLP

(57) ABSTRACT

The invention relates to an elongate retaining element for building sheets, having, as seen in cross section perpendicular to its direction of elongation, a heard part (1) for engaging at least one said building sheets, a base part (3) for mounting the elongate retaining element on a support structure, and a connecting flange (2) extending upwardly from said base part (3) and joining said head part (1) to said base part (3). The elongate retaining element is made from a plastic material, such as PA, and has a reinforcement sheet (4), such as a metal sheet, extending from the connecting flange (2) into at least the head part (1). As seen in cross section, in the head part one free end (5) of the reinforcement sheet is bent into a section with an acute angle of less than 90°.

18 Claims, 3 Drawing Sheets

U.S. PATENT DOCUMENTS

| | | | | |
|---|---|---|---|---|
| 4,757,658 | A * | 7/1988 | Kaempen | 52/309.16 |
| 4,807,414 | A * | 2/1989 | Krause | 52/478 |
| 5,476,704 | A * | 12/1995 | Kohler | 428/119 |
| 5,511,355 | A | 4/1996 | Dingler | |
| 6,158,190 | A * | 12/2000 | Seng | 52/841 |
| 6,179,538 | B1 * | 1/2001 | Palm | 411/399 |
| 6,354,045 | B1 * | 3/2002 | Boone et al. | 52/95 |

FOREIGN PATENT DOCUMENTS

| | | | |
|---|---|---|---|
| DE | 19818769 | | 11/1999 |
| DE | 19818769 | A1 * | 11/1999 |
| DE | 19856524 | | 8/2000 |
| EP | 1069256 | | 1/2001 |
| EP | 1236840 | | 9/2002 |
| GB | 2167101 | | 5/1986 |
| LU | 83447 | | 4/1983 |
| NL | 190292 | | 8/1993 |
| WO | 9853158 | | 11/1998 |

* cited by examiner

ELONGATE RETAINING ELEMENT

CROSS-REFERENCE TO RELATED APPLICATIONS

This application is a §371 National Stage Application of International Application No. PCT/EP2003/009731, filed on 29 Aug. 2003, claiming the priority of European Patent Application No. 02078740.4 filed on 3 Sep. 2002.

FIELD OF THE INVENTION

The invention relates to an elongate retaining element for building sheets, having, as seen in cross section perpendicular to its direction of elongation, a head part for engaging a shaped rib of the building sheet of a roof or a facade or the like, a base part for mounting the elongate retaining element on a support structure by connecting elements, e.g. screws, and a connecting flange extending upwardly from said base and joining said head part to said base. Furthermore, the invention relates to an assembly of at least one such elongate retaining element and at least one building sheet mounted thereby on a support structure.

BACKGROUND OF THE INVENTION

An embodiment of such an elongate retaining element or clip is known from Dutch patent no. 190292. The known elongate retaining element is an elongate extruded aluminium T-shaped profile. As seen in cross section perpendicular to its direction of elongation, the cross bar of the T-shaped profile forms the base part, which is provided with drilled holes for connecting elements such as screws to be passed through the drilled holes for connecting the elongate retaining element to a supporting structure of a building, such as for example supporting beams, T-bearers or similar structural elements manufactured from for example wood, steel, aluminium or concrete. A connecting flange extends perpendicularly from the base part, and ends in a wider head part, that is substantially triangularly shaped in its cross section. The free ends of the building sheets are flanged over the head part to allow for a longitudinal sliding movement of the building sheets relative to the elongate retaining element. The known elongate retaining elements can be e.g. T-shaped, asymmetrically shaped, or L-shaped.

Another embodiment of such an elongate retaining element is known from international application no. WO-98/53158. In this embodiment the base part of the retaining element is provided with a connection permitting longitudinal movement in combination with a limited rotational movement of the connecting flange and the head part relative to the base. Preferably the elongate retaining element is made from an extruded aluminium alloy.

Yet another embodiment of such an elongate retaining element is known from EP-1069256-A1. In this embodiment the base part of the retaining element is provided with a connection permitting longitudinal movement in combination with a limited transverse movement of the connecting flange and the head part relative to the base. In FIG. 1 of this European application the elongate retaining element is schematically shown having a head part with an asymmetrical cross-section with respect to the central longitudinal axis of the connecting flange. The elongate retaining element is made from an extruded aluminium alloy.

It is known that for instance due to a cyclic thermal expansion and contraction of the building structure a longitudinal sliding movement across the head part of a metallic elongate retaining element of the flanges building sheet can cause an unpleasant noise as the metal parts slide over one another. The noise may particularly arise when the building sheets are not situated perfectly parallel to the direction of elongation, a situation that may occur for instance when the supporting structure is not so rigid. The noise may occur also as a result of "haft-reibung" between the retaining element and the building sheet.

Another problem with many roof or facade structures is the occurrence of cold-bridges between the building sheet and the supporting structures as a result of use of various metallic components. Various constructions of a roof or facade are proposed to limited thermal-bridges.

SUMMARY OF THE INVENTION

It is an object of the invention to provide an improved elongate retaining element. A further object of the invention is to reduce the risk of occurrence of the unpleasant noise of the building sheet and the head part sliding over one another. Yet, it is another object of the invention to provide an elongate retaining element with sufficient mechanical strength and stability, such that it can fulfill its function of supporting and connecting a building sheet or sheets to a support structure, while reducing the risk of the occurrence of thermal-bridges between the building sheet and the supporting structure.

According to one aspect of the invention, there is provided an elongate retaining element for building sheets, having, as seen in cross section perpendicular to its direction of elongation, a head part for engaging at least one said building sheets, a base part for mounting the elongate retaining element on a support structure, and a connecting flange extending upwardly from said base part and joining said head part to said base part, characterised in that said elongate retaining element is made from a plastic material and has a reinforcement sheet extending from the connecting flange into at least the head part, and wherein, as seen in cross section, in the head part one free end of the reinforcement sheet is bent into a section with an acute angle of less than 90° with the reinforcement sheet, and more than 0°, and preferably more than 10°.

It is considered a particular improvement to reduce the above-mentioned problem of the unpleasant noise that may occur as the metallic elements slide over one another. Because the head part is being made of a plastic material, the amount of friction that the sheet-like building elements experience while sliding over the head part is significantly reduced. Consequently, the risk of the occurrence of the mentioned unpleasant noise is significantly reduced. Because the plastic material is solid, it will retain its essential properties during the normal economical life of the building construction, regardless of atmospheric temperature and humidity.

Since the reinforcement sheet in the elongate retaining element according to the invention is fully embedded in the plastic material, there is a high durability against disengagement of the plastic material from the reinforcement. The quality of the chemical bonding between the plastic material and the surface of the reinforcement is therefore less critical.

A further advantage is that, due to improved sliding properties of the building sheet over the plastic head part, it further reduces the mechanical load on the connection of the retaining element with the supporting structure.

Yet a further advantage is that there need be no direct contact between the building sheet with any metallic part of the elongate retaining element according to the invention, nor between the supporting structure and any possible metallic part within said the elongate retaining element. Consequently, thermal-bridges, being conductive heat transport via the metallic part of an elongate retaining element, can be readily avoided, or at least significantly reduced. This important reduction of the risk of thermal-bridges is being achieved with one single elongate retaining element, whereas in the prior art fully metallic retaining elements required rather complex constructional measures to be taken in order to reduce the risk of such thermal-bridges. It should be mentioned here that in the past elongate retaining elements of plastic materials without any reinforcement have been tried in order to avoid thermal-bridges. But such fully plastic elongate retaining elements suffered from various disadvantages, such as insufficient mechanical stability. The plastic materials become undesirable brittle below certain sub-zero temperatures, which temperatures are not uncommon in the middle and north of Europe. And when applied in a flat roof structure, in summer time the temperatures at such a structure may easily rise to 80° C. or above, resulting in that the fully plastic elongate retaining element is weakened, thereby even jeopardising the mechanical stability of the whole structure.

That the reinforcement sheet is bent in the head part into a section with an acute angle achieves the effect that the reinforcement sheet is also firmly mechanically embedded in the plastic material, thereby providing an even stronger and more reliable bonding between the reinforcement and the thermoplastic material. Furthermore, the bend section allows for the insertion of a connection element such as a screw or a blind rivet or the like into the head part of the retaining element and through the reinforcement sheet, which connection element being better mechanically bonded to the head part. The introduction of a connection element allows for obtaining a fixing point for the building sheet avoiding sliding down of the building sheet over the retaining element and to avoid mechanical overloading of the thermoplastic retaining element, since part of the mechanical load is immediately transferred to the reinforcement sheet.

In an embodiment the free end of the reinforcement sheet is being bent into a section with an acute angle in a range of 20° to 70°, and preferably in a range of 30° to 60°.

In an embodiment of the elongate retaining element the head part of the retaining element has a substantially asymmetrical cross-section with the central longitudinal axis of the connecting flange.

In an embodiment of the elongate retaining element the head part of the retaining element has a substantially triangular cross-section and which is substantially symmetrical with the central longitudinal axis of the connecting flange.

In an embodiment the reinforcement head part comprises at least two bend sections with an acute angle as set out above, each of which is coupled to the reinforcement connecting flange, and whereby at least a first bend section is bend towards one side of the reinforcement connecting flange and second bend section adjacent to the first bend section is bent towards the other side of the reinforcement connecting flange. Herewith the thermoplastic material wherein the reinforcement head part is embedded is evenly supported by the reinforcement head part.

In an embodiment, the reinforcement comprises a core head part, a core base part, and rigidly coupled to these parts a core connecting flange extending between the core head part and the core base part. Herewith a mechanically reliable connection is established between the base part and the head part of the elongate retaining element. The sheet-like elements are thus mountable on a supporting structure in a stable way. The reinforcement core thus mechanically supports the thermoplastic material, in particular against dynamic and static transverse loads, without leading to the undesirable formation of cold-bridges between the building sheets and the supporting structure of a building. Consequently, also the fatigue-lifetime of the thermoplastic material is significantly enhanced.

In an embodiment shown as FIG. 5, the reinforcement 24 is formed by two separate bent sheets, preferably joined to each other at their respective connecting flanges, each sheet having a core head part 25, a core base part 7 and a core connecting flange 6 embedded in the respective head, base and flange part of the retaining element 24. The core head part 25 and core base part 7 of each metal sheet being bent in the same direction perpendicular to the connecting flange. The reinforcement connecting flanges 6 of the two bent metal sheets are located next to each other such that the reinforcement base parts and the reinforcement head parts of the two adjoining sheets are directed in opposing directions. Herewith a mechanically reliable connection is established between the base part and the head part of the elongate retaining element. The sheet-like building elements are thus mountable on a supporting structure in a stable manner. Thereby, the reinforcement mechanically fully supports the plastic material, in particular against dynamic and static transverse loads, without leading to the formation of cold-bridges between the building sheets and the supporting structure of a building. Consequently, also the fatigue-lifetime of the plastic material is significantly enhanced.

In an embodiment the elongate retaining element comprises one or more supporting ribs extending between the base part and the connecting flange. Herewith, additional mechanical stability is provided, or the transverse stiffness of the retaining element is further improved. The choice of the geometry of said rib or ribs allows for optimisation of the transverse stiffness, which is of particularly importance in designing elongate retaining elements with various restraining distances between the base part and the head part. More preferably the one or more supporting ribs are formed in the plastic material. Herewith, the supporting ribs are relatively easy to form.

A particular advantage is achieved when the reinforcement base part is provided with means, e.g. holes, to be used for mounting the elongate retaining element on a supporting structure. According to this embodiment, the reinforcement core itself has the features of a retaining element. Consequently, should the thermoplastic material be lost or damaged, for example in case of severe wear or even fire, there is still an integral elongate retaining element in the form of the reinforcement core, in particular when made of a metal sheet, to provide an auxiliary support and connection for the building sheets with respect to the supporting structure. A metallic reinforcement core forms a relatively low cost and reliable form of reinforcement.

In an embodiment the reinforcement sheet is made of a metal sheet. The metal sheet can be made of carbon steel, which is not expensive and has a high strength. Preferably the metallic reinforcement core is made of galvanised carbon steel, to further prevent corrosion of the metallic reinforcement core. Alternatively, the metallic reinforcement core can be made of stainless steel, titanium, or an aluminium alloy, or other suitable metal. The thickness of the metal sheets are typically in the range of 0.5 to 5 mm, and preferably in the range of 0.5 to 3 mm, and the thickness may be chosen in dependence of the expected mechanical load.

In an embodiment the reinforcement sheet is made from a non-metallic material selected from the group of glass fibre, whiskers, aramid fibre, carbon fibre, ceramic fibre, and para-aramid synthetic fiber, such as KEYLAR (trade mark) para-aramid synthetic fiber. These materials combine a high Young modulus with a high strength, and can be aligned into the direction of the expected mechanical load or stresses.

In an embodiment the plastic material is an injection moulded plastic material. Herewith an elongate retaining element is provided which is easy and cost effective to manufacture. The metal core parts and solid plastic parts are integrated with each other in an easy way.

In an embodiment the plastic material is thermoplastic material such as PVC, PA, PE, PUR, PP, PDFE or cellulose polymers. In particular advantages are thermoplastic selected from a polyester, a polyamide, a modified polyester, or a modified polyamide. These thermoplastic materials have one or more of the properties of low friction, high wear resistance, good temperature stability to temperatures up to 100° C., good elastic properties, and high flame resistance. Furthermore, these thermoplastic materials can be processed via injection moulding techniques. Polyamides ("PA") in general are found to be sufficiently durable, and to have a favourable low coefficient of friction and good flame resistance and are an accepted construction material.

In an embodiment plastic material is a thermosets, such as phenolics, amino-plastics, epoxys, polyurethanes and polyester. These thermset materials can be processed via injection moulding techniques.

According to the invention in another aspect, there is provided an assembly of at least one such elongate retaining element and at least one building sheet mounted thereby on a support structure.

According to the invention in another aspect, there is provided an assembly comprising at least one building sheet and at least one elongate retaining element according to the invention engaging said building sheet to retain it on a support structure, and wherein there is provided at least a holding element, such as a screw or a rivet, penetration through the building sheet into at least the head part of said elongate retaining element and through the bent section of the reinforcement.

BRIEF DESCRIIPTION OF THE DRAWINGS

The invention will now be illustrated by several non-limitative embodiments, with reference to the accompanying drawings, in which.

DETAILED DESCRIPTION OF THE PERFERRED EMBODIMENTS

Figure 1:
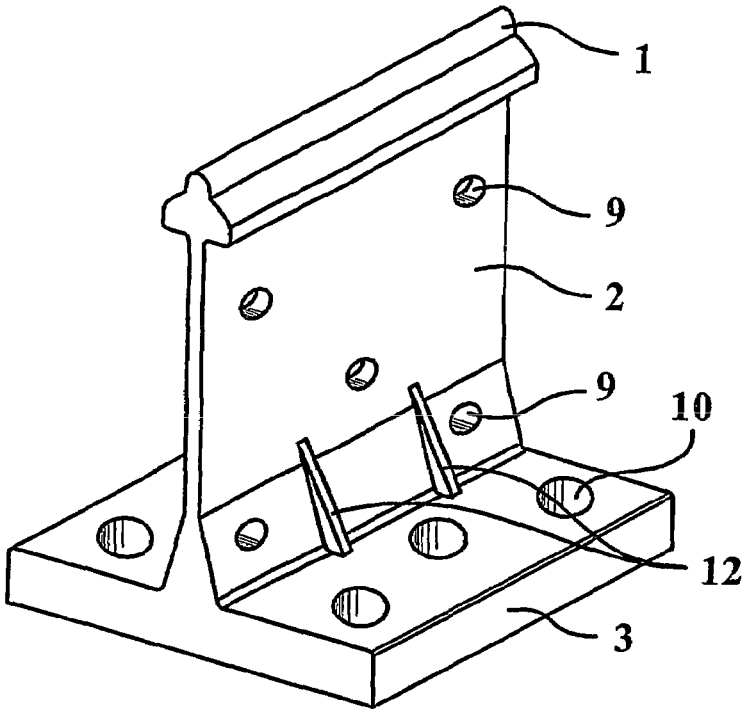
FIG. 1 shows a schematic perspective view of an elongate retaining element according to the invention.

FIG. 1 shows schematically an elongate retaining element consisting of a head part 1, a connecting flange 2, and a base part 3 for mounting on a supporting structure. The head part can work together with sheet-like building elements, whereby the free ends of two adjacent sheet-like building elements are flanged one on top of the other along the longitudinal head part, as shown in Dutch patent 190292, and which is incorporated herein by reference. The base part is provided with holes 10 for working together with connecting elements, e.g. screws, for mounting the elongate retaining element onto a supporting structure. The elongate retaining element of FIG. 1 has a reinforcement sheet or core (not shown in FIG. 1), in an embodiment a metallic reinforcement fully embedded in the plastic material. In particular the elongate retaining element can be provided with one or more supporting ribs 12 to further improve the mechanical stability of the elongate retaining element.

Figure 2:
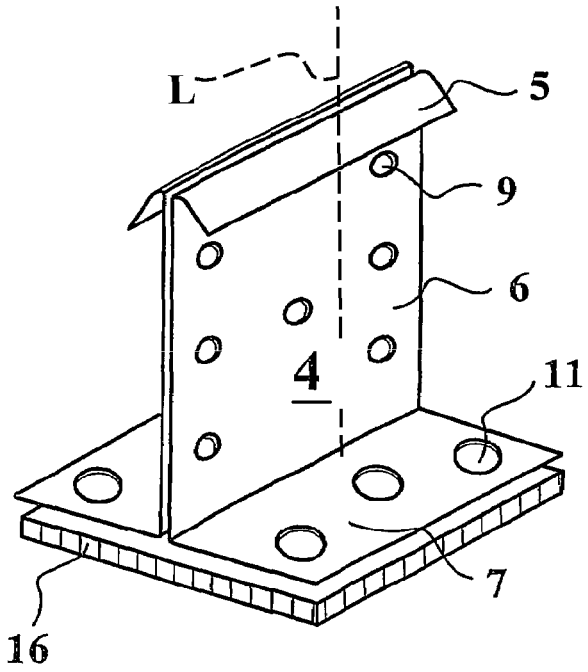
FIG. 2 shows a schematic perspective view of an reinforcement core according to the invention for application in the retaining element according to FIG. 1.

FIG. 2 schematically shows an embodiment of the reinforcement core or sheet 4 for covering with the plastic material to form the elongate retaining element. The reinforcement comprises of two bent metal sheets, each sheet having a bend reinforcement head part 5, a reinforcement connecting flange 6 and a reinforcement base part 7. In each reinforcement sheet the base part is bent essentially perpendicular to the direction of elongation (along a longitudinal axis "L")of the connecting flange, and the head part is being bent in the same direction but into a section with an acute angle relative to the direction of elongation (along longitudinal axis "L") of the connecting flange. The two sheets may be connected to one another to form a single reinforcement core or element, such a connection can be made typically via adhesion bonding or welding in case of a metallic sheet, such as butt welding. At the base part of the retaining element there may be provided a supplementary reinforcement sheet 16, typically in metal sheet having a thickness in the range of 1 to 3 mm, and typically about 2 mm, for the application is special fasteners. The skilled person will immediately recognise that the base part of the elongate retaining element can also be asymmetrical.

Figure 3A:
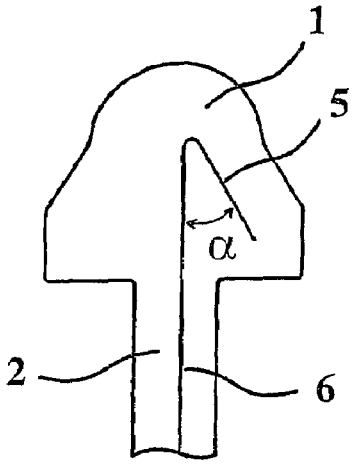
FIGS. 3A, 3B and 3C show in cross-section enlarged embodiments of the head part of the elongate retaining element according to the invention.
Figure 3B:
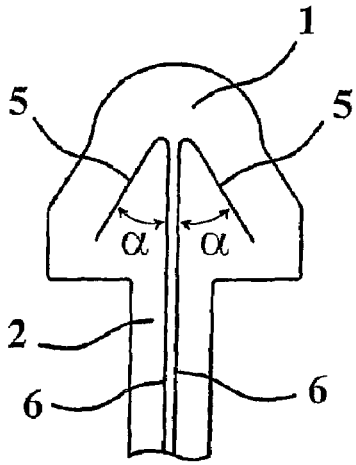
Figure 3C:
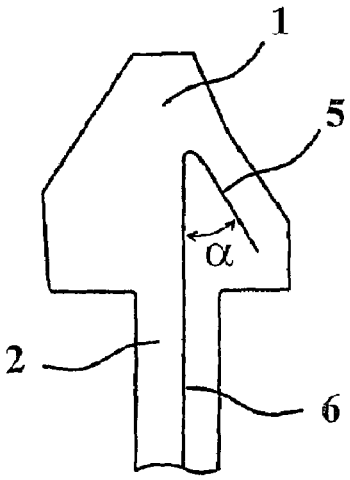

FIG. 3A shows schematically the head part of the reinforced retaining element according to the invention. The shown head part 1 has a substantially triangular cross-section and which is substantially symmetrical with the central longitudinal axis of the connecting flange 2. The reinforcement sheet 5, 6 extends from the connecting flange 2 into at least the head part 1, and wherein, as seen in cross section, in the head part 1 one free end 5 of the reinforcement sheet is bent into a section with an acute angle $\alpha$ of less than 90° and more than 0°, and typically in the range of about 40° to about 50°. The advantages have been set out above. FIG. 3B shows a similar head part as in FIG. 3A, but wherein there are present two reinforcement sheets the bent sections 5 extending into two opposing directions. And FIG. 3C shows a similar approach as in FIG. 3A, but wherein the head part 1 of the retaining element has a substantially asymmetrical cross-section with respect to the central longitudinal axis of the connecting flange 2.

Figure 4:
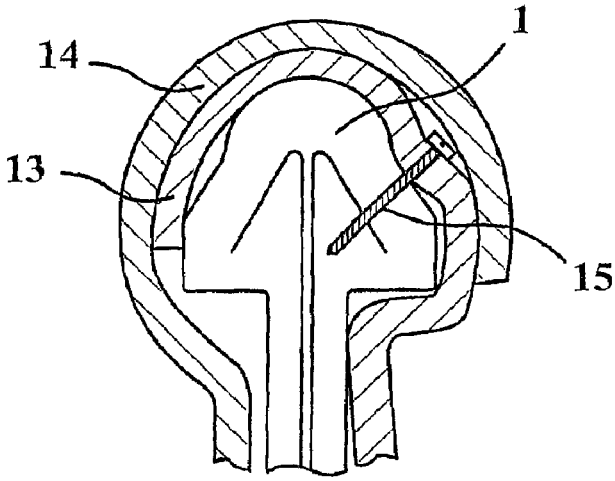
FIG. 4 shows in cross-section an embodiment of the head part of the elongate retaining element according to the invention.
Figure 5:
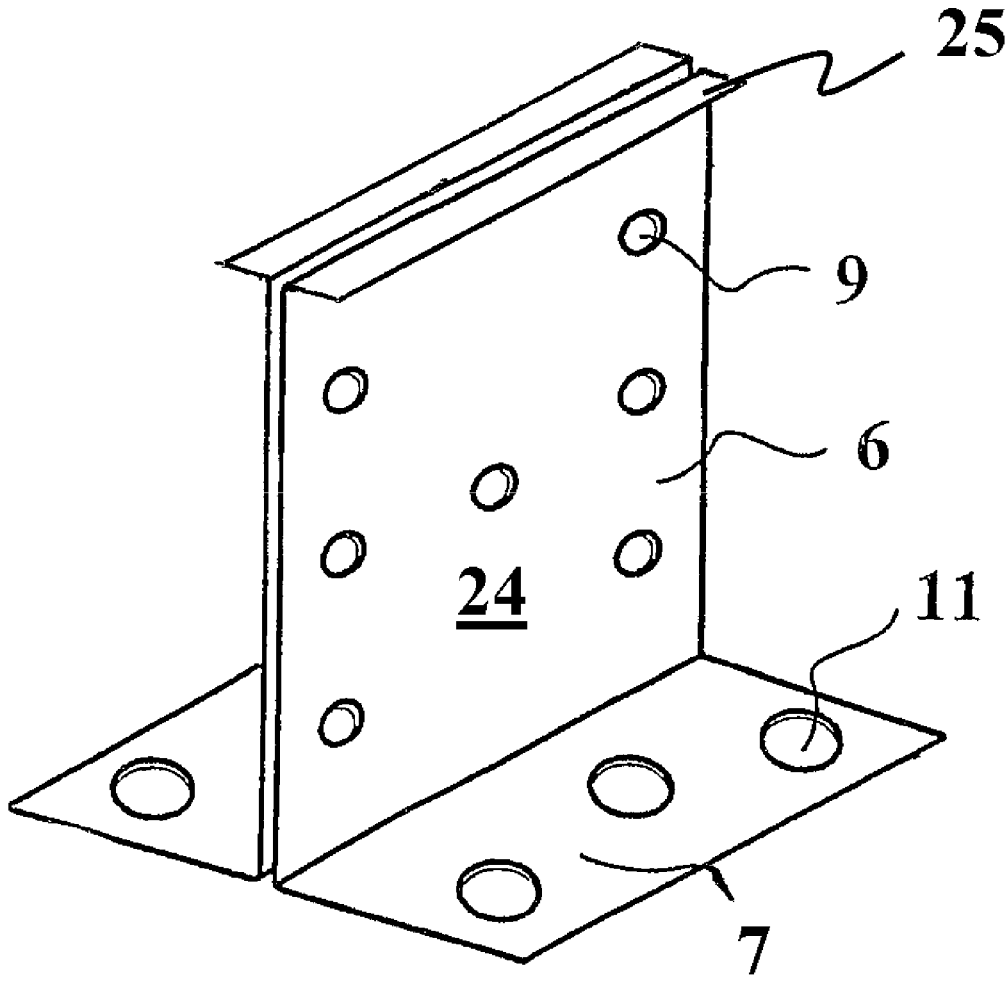
FIG. 5 shows a schematic perspective view of another embodiment of a reinforcement core according to the present invention for application in the retaining element according to FIG. 1.

FIG. 4 shows schematically the head part of an elongate retaining element according to the invention as shown in FIG. 3B, engaged with the free ends of a first building sheet material 13 and the free ends of a second building sheet material 14. The first building sheet material 13 has been mechanically connected to the head part of the elongate retaining element via a holding element 15, such as e.g. a screw, the holding element penetrating through the building sheet material and into the plastic head part 1 through the bent section 5 of the reinforcement. The advantages of which have been sent out above.

The reinforcement core or sheet 4, such as the one shown in FIG. 2, can be placed inside an injection mould for embedding it in a solid plastic material. Tools, e.g. punching or drilling, for fixing the reinforcement inside the mould cavity, have made the multiple holes 9 in at least the connecting flanges. Furthermore, this achieves the effect that during injection moulding the plastic materials will fill those holes thereby achieving also a strong mechanical bonding between the plastic retaining element and the reinforcement.

The reinforcement may be provided with one or more holes 11 in its base part before placing it into the injection mould. Herewith is achieved that the inside of the holes will be filled in part or in whole with the plastic material, such that after mounting the elongate retaining element to a supporting structure, there is no contact between the connecting elements and the reinforcement, and thereby corrosion of a metallic reinforcement base part is avoided. The connection elements, e.g. screws or bolds, hold the elongate retaining elements firmly to the supporting structure avoiding any metallic contact between the building sheets and the supporting structure, thereby reducing or even avoiding the formation of thermal-bridges.

Wear tests have been performed with a reinforced elongate retaining element in accordance with the invention, such as the one shown in FIG. 1. The elongate retaining element contained a galvanised steel reinforcement as shown in FIG. 2, and the reinforcement sheet had a mean thickness of 1.0 mm. The plastic material was an essentially fully continuous layer of a modified polyamide, having a thickness of 2.3 mm on either side of the connecting flange. The elongate retaining element had been made via an injection moulding process. During a load bearing capacity test, an aluminium building sheet has been flanged over the head part, and the combination of the retaining element and the building sheet fulfilled the life-time expectation. No indication of wear was observed in the head part of the elongate retaining element according to the invention.

Having now fully described the invention, it will be apparent to one of ordinary skill in the art that many changes and modifications can be made without departing from the spirit or scope of the invention as hereon described.

The invention claimed is:

1. An elongate retaining element for building sheets, comprising, as seen in cross section perpendicular to the retaining element's direction of elongation:

a head part for engaging at least one said building sheets when the free ends of two adjacent building sheets are flanged one sheet on top of the other sheet along the head part, a base part for mounting the elongate retaining element on a support structure, a connecting flange extending upwardly from said base part and joining said head part to said base part, wherein said elongate retaining element head part, base part and connecting flange comprise a plastic material, one or more supporting ribs extending between the base part and the connecting flange, and at least one reinforcement sheet having a reinforcement base part and extending along a longitudinal axis of the reinforcement sheet from the connecting flange into at least the head part, the base part having mounting holes extending through the plastic material of the base part, and the reinforcement base part having holes extending through the reinforcement sheet, wherein one or more of the base part mounting holes are aligned with respective said reinforcement base part holes for mounting the elongate retaining element on the support structure, wherein, as seen in cross section, in the head part one free end of the reinforcement sheet is bent into a section with an acute angle of less than 90° with the reinforcement sheet longitudinal axis, wherein the head of the retaining element has a substantially triangular cross-section which is substantially symmetrical with the central longitudinal axis of the connecting flange, wherein the at least one reinforcement sheet comprises at least two bent sheets, in the head part the free end of each bent sheet section directing in opposing directions.

2. An elongate retaining element according to claim 1, wherein the free end of the reinforcement sheet is bent into a section with an acute angle in a range of 20° to 70°.

3. An elongate retaining element according to claim 1, wherein the head has a first end proximal to the connecting flange and an opposed second end distal to the connecting flange, the head first end being in width wider than said connecting flange and wider than the head second end.

4. An elongate retaining element according to claim 1, wherein the reinforcement sheet is made from a metal.

5. An elongate retaining element according to claim 1, wherein the reinforcement sheet is made from a non-metallic material selected from the group of glass fibre, carbon fibre, ceramic fibre, aramid fibre , and para-aramid synthetic fiber.

6. An elongate retaining element according to claim 1, wherein the plastic material is thermoplastic material.

7. An assembly comprising at least one building sheet and at least one elongate retaining element according to claim 1, engaging said building sheet to retain said building sheet on a support structure.

8. An assembly comprising at least one building sheet and at least one elongate retaining element according to claim 1, said at least one elongate retaining element engaging said building sheet to retain said building sheet on a support structure, and wherein there is provided at least an holding element penetrating through the building sheet into at least the head part of said elongate retaining element.

9. An elongate retaining element according to claim 1, wherein the free end of the reinforcement sheet is bent into a section with an acute angle in a range of 30° to 60°.

10. An elongate retaining element according to claim 1, wherein the reinforcement sheet is made from aluminium alloy or steel.

11. An elongate retaining element according to claim 1, wherein the plastic material is thermoplastic material selected from the group consisting of polyester, a polyamide, a modified polyester, or a modified polyamide.

12. An elongate retaining element according to claim 1, wherein the reinforcement sheet is covered by the plastic material.

13. An elongate retaining element according to claim 1, wherein the head has a first end proximal to the connecting flange and an opposed second end distal to the connecting flange, the head first end being in width narrower than said base part and wider than said connecting flange, the head second end being narrower than the head first end.

14. An elongate retaining element according to claim 1, wherein the base part of the retaining element further comprises a supplementary reinforcement metal sheet having a thickness in the range of 1 to 3 mm.

15. An elongate retaining element for building sheets, comprising, as seen in cross section perpendicular to the retaining element's direction of elongation:

a head part for engaging at least one said building sheets when the free ends of two adjacent building sheets are flanged one sheet on top of the other sheet along the head part, a base part for mounting the elongate retaining element on a support structure, a connecting flange extending upwardly from said base part and joining said head part to said base part, wherein said elongate retaining element head part, base part and connecting flange comprise a plastic material, one or more supporting ribs extending between the base part and the connecting flange, and at least one reinforcement sheet having a reinforcement base part and extending along a longitudinal axis of the reinforcement sheet from the connecting flange into at least the head part, the base part having mounting holes extending through the plastic material of the base part, and the reinforcement base part having holes extending through the reinforcement sheet, wherein one or more of the base part mounting holes are aligned with respective said reinforcement base part holes for mounting the elongate retaining element on the support structure, wherein, as seen in cross section, in the head part one free end of the reinforcement sheet is bent into a section with an acute angle of less than 90° with the reinforcement sheet longitudinal axis, wherein the head of the retaining element has a substantially triangular cross-section which is substantially symmetrical with the central longitudinal axis of the connecting flange, wherein the at least one reinforcement sheet comprises at least two bent sheets, the free end of each bent sheet section in the head part is bent, directing in opposing directions, into a respective section with an acute angle of less than 90° with the reinforcement sheet.

16. An elongate retaining element for building sheets, comprising, as seen in cross section perpendicular to the retaining element's direction of elongation:

a head part for engaging at least one said building sheets when the free ends of two adjacent building sheets are flanged one sheet on top of the other sheet along the head part, a base part for mounting the elongate retaining element on a support structure, a connecting flange extending upwardly from said base part and joining said head part to said base part, wherein said elongate retaining element head part, base part and connecting flange comprise a plastic material, one or more supporting ribs extending between the base part and the connecting flange, and at least one reinforcement sheet having a reinforcement base part and extending along a longitudinal axis of the reinforcement sheet from the connecting flange into at least the head part, the base part having mounting holes extending through the plastic material of the base part, and the reinforcement base part having holes extending through the reinforcement sheet, wherein one or more of the base part mounting holes are aligned with respective said reinforcement base part holes for mounting the elongate retaining element on the support structure, wherein, as seen in cross section, in the head part one free end of the reinforcement sheet is bent into a section with an acute angle of less than 90° with the reinforcement sheet longitudinal axis, wherein the at least one reinforcement sheet is two separate bent metal reinforcement sheets, each sheet having a core head part comprising the head part one free end and a portion of the reinforcement sheet extending along the longitudinal axis within the head part, a core base part comprising the reinforcement base part, and a core connecting flange comprising a portion of the reinforcement sheet extending through the connecting flange embedded in the respective head, base and flange part of the retaining element;

core base part of each metal sheet being bent perpendicular to the connecting flange;

the reinforcement connecting flanges of the two bent metal sheets are next to each other;

the reinforcement base parts are directed in opposing directions; and the reinforcement head parts are directed in opposing directions.

17. An elongate retaining element according to claim 16, wherein the two separate bent metal reinforcement sheets are joined at their connecting flanges.

18. An elongate retaining element according to claim 16, wherein the head has a first end proximal to the connecting flange and an opposed second end distal to the connecting flange, the head first end being in width wider than said connecting flange and wider than the head second end.

* * * * *

UNITED STATES PATENT AND TRADEMARK OFFICE

CERTIFICATE OF CORRECTION

PATENT NO. : 7,603,825 B2
APPLICATION NO. : 10/525556
DATED : October 20, 2009
INVENTOR(S) : Hans-Jürgen Döhren It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1051 days.

Signed and Sealed this

Fifth Day of October, 2010

David J. Kappos

David J. Kappos
*Director of the United States Patent and Trademark Office*